United States Patent [19]

Cavazza

[11] 4,402,529

[45] Sep. 6, 1983

[54] SKI POLE FOR MOUNTAIN SKIING

[75] Inventor: Gilbert J. Cavazza, Viuz en Sallaz, France

[73] Assignee: Kerma Société A Responsabilité Limitée, Sallanche, France

[21] Appl. No.: 254,302

[22] Filed: Apr. 15, 1981

[30] Foreign Application Priority Data

Jan. 14, 1981 [FR] France ..... 81 00919

[51] Int. Cl.[3] ..... A63C 11/22

[52] U.S. Cl. ..... 280/816; 280/821; 280/823; 135/66; 30/161

[58] Field of Search ..... 280/816, 823, 821; 30/151-158, 164.5-164.8, 160-161; 7/145, 151; 224/232; 145/75-76, 2 A-2 R; 135/66

[56] References Cited

U.S. PATENT DOCUMENTS

| | | | |
|---|---|---|---|
| 576,862 | 2/1897 | Lebold | 30/161 |
| 1,415,887 | 5/1922 | McWilliams | 30/164.5 |
| 1,580,528 | 4/1926 | Perkins | 7/145 |
| 2,494,878 | 1/1950 | Jensen | 280/823 |
| 3,525,532 | 8/1970 | Baldsiefen | 280/820 |
| 4,023,221 | 5/1977 | Cadman | 7/145 |
| 4,172,601 | 10/1979 | Hutter | 280/816 |
| 4,288,102 | 9/1981 | Ramer | 280/823 |

*Primary Examiner*—David M. Mitchell
*Assistant Examiner*—Timothy Roesch
*Attorney, Agent, or Firm*—Karl F. Ross; Herbert Dubno

[57] ABSTRACT

A ski pole has a handle in which at least one ice-ax blade is pivotally mounted and blocked in a retracted position by a detent which can be released to permit this blade to swing out and lock in an extended position. The pole shank may be formed from two interconnected but separable portions so that the portion joined to the handle can form the shaft of the ice-ax.

14 Claims, 7 Drawing Figures

FIG.1
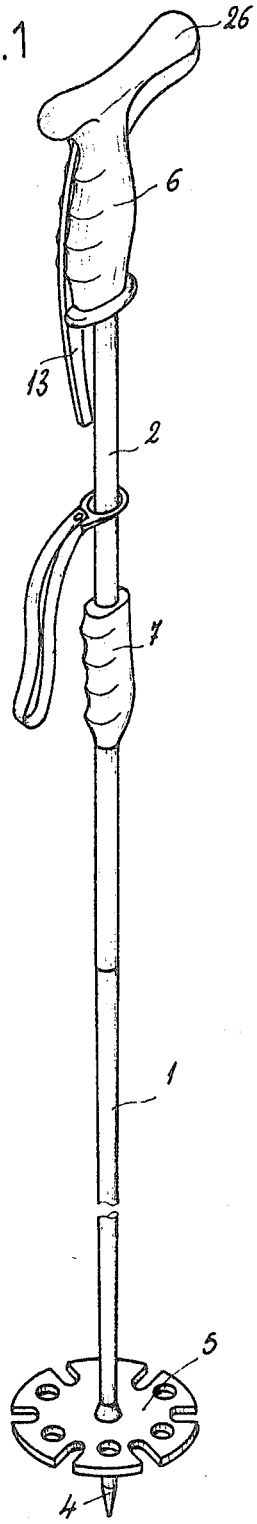
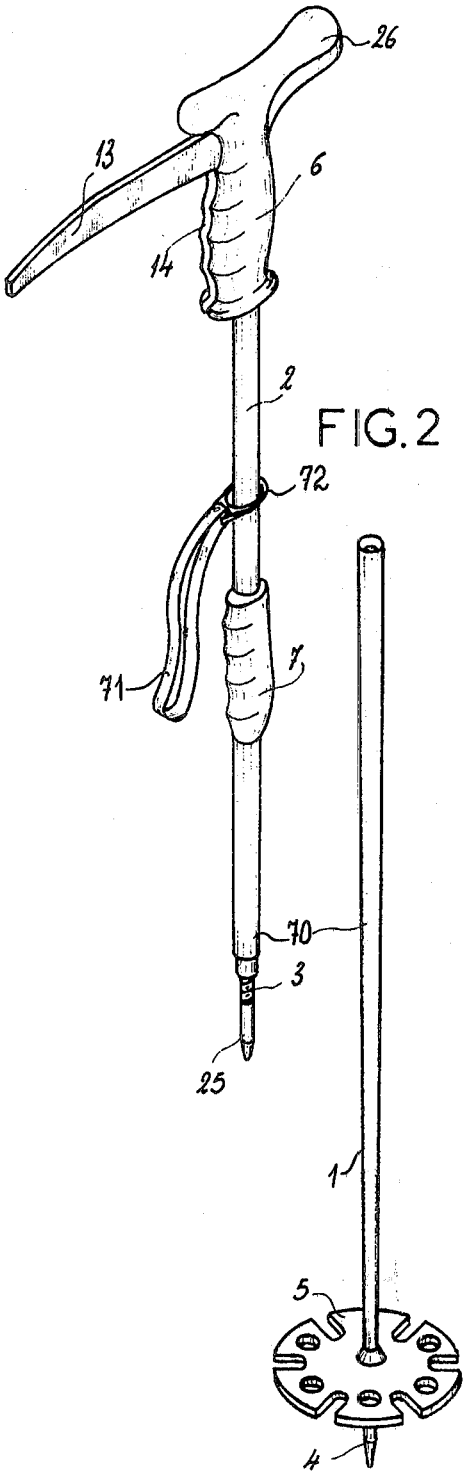
FIG.2

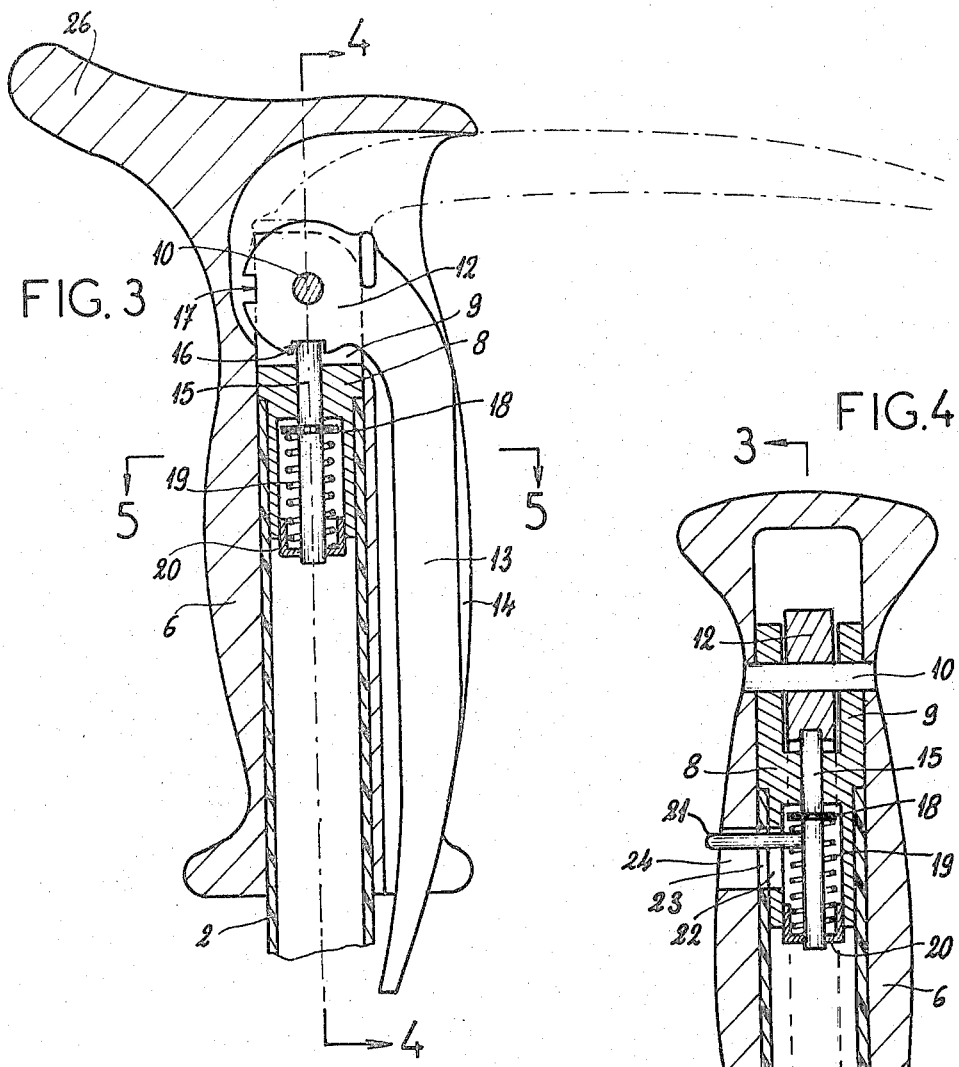
FIG. 3
FIG. 4
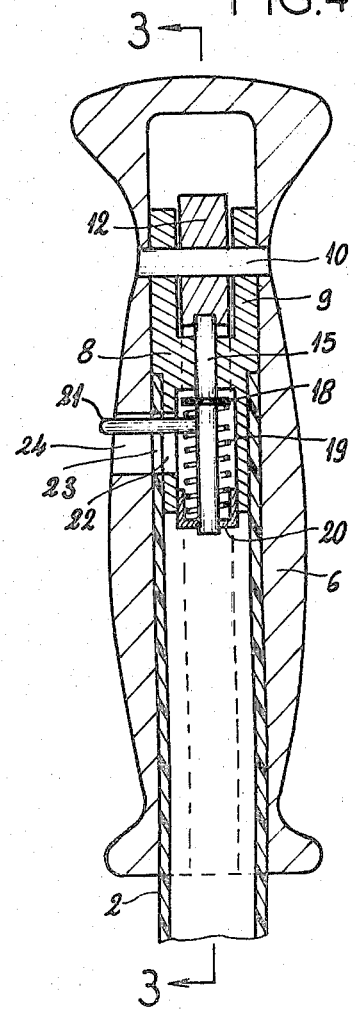
FIG. 5
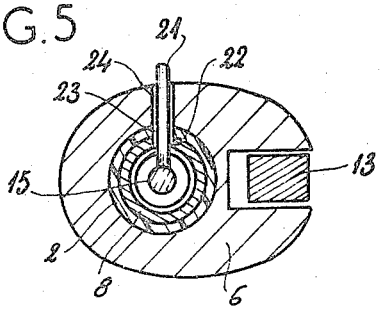

FIG.7
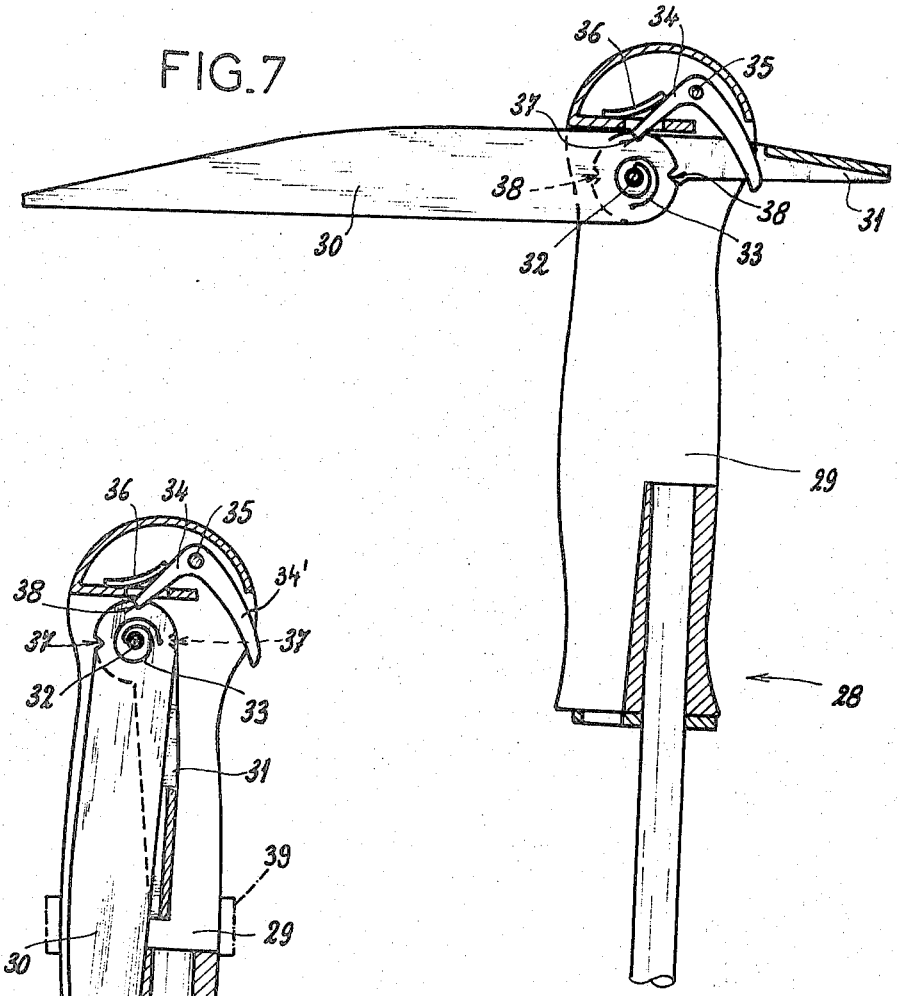
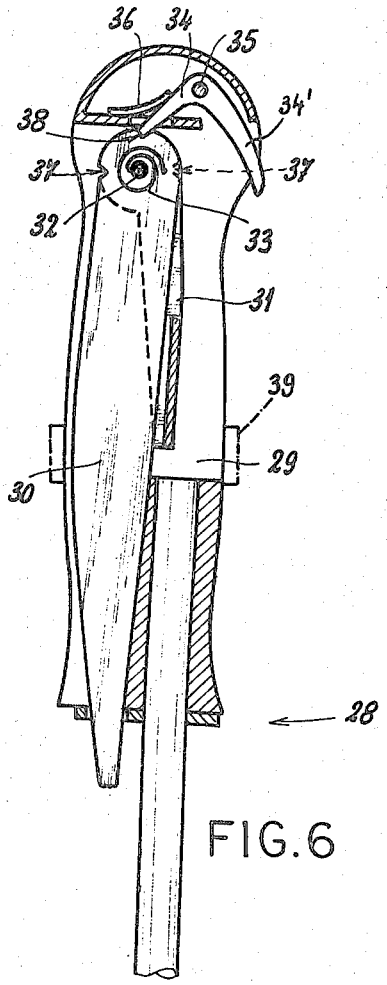
FIG.6

SKI POLE FOR MOUNTAIN SKIING

FIELD OF THE INVENTION

My present invention relates to a ski pole and, more particularly, to a ski pole which can be used as an ice-ax and is particularly adapted for skiing in mountainous regions and especially for so-called alpine tour skiing.

BACKGROUND OF THE INVENTION

Skiing is mountainous regions, alpine touring and, in general, skiing in rocky, steep or like irregular terrain, frequently requires that the skier be in possession not only of the usual ski paraphernalia but also an ice-ax to enable the skier to climb the mountainous terrain in preparation for his descent. Thus the skier frequently carries a backpack in which a piolet or ice-ax is received, as well as the usual pair of ski poles each of which can comprise a handle or grip at the upper end thereof, an elongated shank, and a snow-engaging member, e.g. a disk at the lower end of the ski pole which can also be provided with a point.

While the piolet is usually indispensable during the ascent, at least for most of the descent it need not be used and thus can remain in the backpack.

However, for certain passages and delicate terrains, the skier may find a need for the piolet and thus is required to remove it from his backpack. Such operations and the loss of time in removing the piolet from the backpack has limited practical use of the piolet even in cases where ready availability of the piolet would be a substantial asset. Accordingly, the safety of the skier may be jeopardized. On the other hand, it is neither safe nor practical for the skier to keep the piolet constantly in hand during skiing because of the danger posed by the pointed blade of the piolet.

Another disadvantage of a piolet which must be carried in the backpack is the weight of the implement and skiers on an alpine tour generally try to free themselves from excess weight to the greatest possible extent. Accordingly, there is a tendency in some cases for the skier not to carry an effective piolet, thereby again enhancing the danger when difficult passages are encountered.

OBJECTS OF THE INVENTION

It is the principal object of the invention to overcome the aforementioned drawbacks and provide a unit which will increase the safety of the skier, especially while traversing mountainous terrains or in alpine tour skiing and which nevertheless will reduce the weight which a skier must carry on his back.

Yet another object of this invention is to provide an improved ski pole.

SUMMARY OF THE INVENTION

These objects and others which will become apparent hereinafter are attained, in accordance with the present invention, by providing a ski pole which can be practically instantaneously and with a minimum of manipulation transformed into a piolet or ice-ax.

According to the invention, the ski pole having an elongate shank, a handle or grip at the upper end of this shank and a snow-engaging device, e.g. a disk and point at the lower end of the shank, is provided at the upper end with at least one elongated piolet blade which is articulated at one end within the handle or grip which can have a slot in which the blade is fully received.

More particularly, the blade, which is of rectangular cross section and generally rectangular shape and has a tapering extremity opposite its articulated extremity, is pivotally connected to the articulated extremity in the upper end of the handle and within the latter while the handle is formed with an elongated slot whose length, depth and width are sufficient to fully receive the blade when the pole is utilized exclusively as a ski pole.

The blade is pivoted out of this slot, preferably into a position in which it is generally perpendicular to the shank so that at least its tapered end protrudes from the handle when the pole is used as a piolet or ice-ax.

According to a feature of the invention, locking means is provided for latching the blade in its retracted position fully received within the slot.

It has been found to be advantageous and hence is an important feature of the invention that the shank comprises at least two separable portions which can be joined together, e.g., by a screw thread, the shank portion connected to the handle and the blade being constituted as the shaft or head of the piolet upon separation from the blades of the ski pole. The two separable elements forming the shank are preferably tubular. The upper shank portion advantageously is provided at its lower end with a point which can be received in the tubular lower portion of the shank and advantageously is of a hardened metal which can correspond to the point at the end of the shaft or head of the piolet.

According to yet another feature of the invention, a second blade is pivotally mounted in the handle and receivable in a slot thereof advantageously having the same pivot as the first mentioned blade. This second blade may be comparatively short and can be formed as the usual peen of the ice-ax.

According to one aspect of the invention the blade or blades may be provided with a round end portion at the articulated extremity, this end portion being provided with a plurality of notches one of which is engaged by the detent to retain the blade in its retracted position while another notch, angularly offset by 90° from the first, is engaged by the detent to lock the blade in its extended position.

The detent may be a spring loaded pin mounted in line with the shank of the ski pole and having a laterally extending actuating member. Alternatively, the detent may be a pivotal lever which is biased by a spring into engagement with the notches. It also has been found to be advantageous to provide the upper shank portion, adapted to form the handle of the piolet with a grip below the ski pole handle, thereby facilitating manipulation of the piolet.

BRIEF DESCRIPTION OF THE DRAWING

The above and other objects, features and advantages of the present invention will become more readily apparent from the following description, reference being made to the accompanying drawing in which:

FIG. 1 is a perspective view of a ski pole embodying the present invention, the piolet blade being shown in its retracted position and the portions of the shank as interconnected;

FIG. 2 is a view similar to FIG. 1 but in exploded form, i.e. showing the upper shank portion separated from the lower shank portion and the piolet blade extended so that the upper part of the ski pole can serve as a piolet;

FIG. 3 is an axial cross sectional view drawn to a larger scale than FIGS. 1 and 2, showing the ski pole handle and the blade in relation thereto, this section corresponding to the section taken along line 3—3 of FIG. 4;

FIG. 4 is a longitudinal section taken along line 4—4 of FIG. 3;

FIG. 5 is a transverse section taken along the line 5—5 of FIG. 3;

FIG. 6 is a longitudinal section through a second embodiment of the invention illustrating the retracted position of the blade for skiing use; and FIG. 7 is a similar view but with the blade extended for use as an ice-ax.

SPECIFIC DESCRIPTION

In the embodiment of FIGS. 1 through 5, the ski pole comprises a shank 70 constituted by two tubular elements which are preferably metallic, namely, the lower shank portion 1 and the upper shank portion 2 which can be joined together by a screw of a male thread 3 and a screw joint whose female thread is not visible but is formed in the upper end of shank portion 1.

As is usually the case with ski poles, the shank 70 terminates at its lower end in point 4 and carries in the region of this point a disk or ring 5 forming the snow-engaging means.

At the upper end of the shank 70, i.e. at the upper end of shank portion 2, there is provided a handle 6. Substantially midway along the shank portion 2, moreover, an auxiliary handle or grip 7 is provided for ice-ax use. Both handles can be composed of a material conventional for use in ski pole grips. The handle 6 is used primarily when the device is employed as a ski pole, the grip 7 generally being unused at this time. However, on occasion the skier may wish to grip the pole below the handle 6 and the grip 7 is useful for this purpose as well. The strap loop for preventing loss of the pole, shown at 71, can slide on a ring 72 between the two grips.

However, when the upper portion of the ski pole is used as an ice-ax, the handle 7 is conveniently located for this purpose.

A bushing 8 is fitted into the upper end of the shank portion 2 and has a pair of lugs 9, extending upwardly and defining a space between them in which the head 12 of a blade 13 can be received. The head 12 is traversed by a pivot pin 10 anchored in the lugs 9 so that the blade 13 which is generally of rectangular cross section is swingable about an axis defined by the pin 10 and perpendicular to the axis of the shank 70.

The blade 13 tapers away from the handle 12 which is rounded, and thus corresponds to the long pointed member of a conventional ice-ax.

The handle 6, which can be molded from synthetic resin material, is formed over substantially its entire height from its lower end upwardly, with a slot 14 adapted to receive the blade 13 when the latter is in the retracted position shown in solid lines in FIG. 1. In this position the blade is wholly received in the slot.

Means are provided to latch the blade 13 in its retracted position shown in FIG. 1 or in its extended position shown in dot-dash lines in FIG. 3 and in solid lines in FIG. 2.

This latching means can include a detent pin 15 which is mounted so as to be axially movable in a passage of the bushing 8 and which, at its upper end, can engage in either of two notches 16 and 17 formed in the head 12 and angularly spaced by 90° about the pivot axis 10 with which this head is concentric.

The pin 15 is provided with an abutment 18, e.g. a circlip or spring clip received in a groove, which forms a seat for a helicoidal compression spring 19 which surrounds the lower portion of the pin 15, is received within the bushing 8, and bears upon a cap or plug 20 which can be screwed into this bushing.

The spring 19 thus biases the pin 15 upwardly to engage the notch 16 and retain the blade 13 in its retracted position within the groove 14.

The pin 15 carries a finger 21 which projects laterally through a slot 24 in the grip 6 and a slot 23 in the upper tube portion 2, these slots being aligned with a window 22 in the bushing 8. When the handle 21 is moved downwardly (FIG. 4), the blade 13 can be swung outwardly into the position shown in dot-dash lines whereupon the pin 15 enters the notch 17 and locks the blade in place.

Thus when the ice-ax is to be used, the blade is swung in the position shown in FIG. 2 and latched in this position. If desired, the upper shank portion 2 can be unscrewed from the lower shank portion 1 thereby separating the ice-ax from the remainder of the ski pole. The lower end of the shank portion 2 is provided with a point 25 which can be of hardened steel and identical to the point normally provided on the shaft of a piolet.

The handle 6 has a projecting boss 26 which extends in the direction opposite that of the blade to form the peen of the ice-ax. The part of the handle can be formed with metal or reinforced with metal upon which the plastic material is molded.

In the embodiment of FIGS. 6 and 7 the ski pole 28 has its upper end formed with a handle 29 provided with a longitudinal throughgoing slot which serves to receive two opposite metal blades 30 and 31, the blade 30 corresponding to the long point of a piolet while the blade 31 corresponds to the peen thereof.

Both blades are pivotally mounted on the same transverse pivot 32 around which a torsion spring 33 is provided which tends to swing the blades in opposite senses, i.e. outwardly, into the position shown in FIG. 7. A similar torsion spring can also be provided to swing the blade 13 outwardly.

In this embodiment the detent is formed by a finger 34 of a lever fulcrumed at 35 to the handle and actuatable by the skier via an arm 34′ against the force of leaf spring 36. The finger 34 can engage in a pair of notches 38 of the blades 30 and 31, to hold them in the retracted position shown in FIG. 6. When the detent is released, therefore, these blades swing outwardly and are simultaneously locked in their extended positions (FIG. 7) by engagement in the notches 37 of the two blades, each notch 37 being angularly offset by 90° about the pivot axis from the notch 38 of the respective blade. A ring or collar 39, shown in dot-dash lines, can be provided on the handle to prevent accidental opening of the blades and is disposed so that it must be first shifted axially before the lever 34 can be actuated as a safety measure.

The fact that the upper portion is separable from the lower portion from the ski pole enables various accessories to be mounted on either portion. For example a shovel or hammer can be connected to the screw thread at the bottom of the upper portion or at the top of the lower portion, respectively.

I claim:

1. A ski pole comprising:

an elongated shank;

a handle formed on the upper end of said shank and having a longitudinally extending slot therein;

snow-engaging means at the lower end of said shank; and an elongated piolet blade of generally rectangular configuration pivotally connected at one end in said handle and swingable between the retracted position wherein said blade is substantially fully received in said slot and an extended position wherein said blade extends from said handle to lie transverse to said handle and form an ice-ax, an upper end of said handle having a projection in a direction opposite to said blade in the extended position thereof to serve as a piolet peen.

2. The ski pole defined in claim 1 wherein said shank is formed from two tubular elements detachably interconnected and including an upper element connected to said handle and a lower element connected to said snow-engaging means, said upper element being formed at its extremity remote from said handle with a piolet point receivable in said lower element.

3. The ski pole defined in claim 2, further comprising screw thread means for detachably interconnecting said elements.

4. The ski pole defined in claim 3 wherein said screw thread means includes a thread on said extremity of said upper element enabling connection thereof to an accessory.

5. The ski pole defined in claim 3 wherein said screw thread means includes a threaded upper extremity of said lower element enabling the connection thereof to an accessory.

6. The ski pole defined in claim 1 wherein said handle is formed of molded plastic with said projection.

7. The ski pole defined in claim 1, further comprising detent means cooperating with said blade for releasably latching same in each of said positions.

8. The ski pole defined in claim 7 wherein said shank is tubular and receives a housing disposed in said handle and having a pair of upstanding lugs between which said blade is journaled, said detent means including a pin longitudinally displaceable in said bushing and engageable selectively in a pair of notches formed in said blade, a coil spring urging said pin against said blade, and a laterally extending member connected to said pin and enabling retraction of said pin from said notches by a skier.

9. A ski pole comprising:

an elongated shank;

a handle formed on the upper end of said shank and having a longitudinally extending slot therein;

snow-engaging means at the lower end of said shank;

an elongated piolet blade of generally rectangular configuration pivotally connected at one end in said handle and swingable between the retracted position wherein said blade is substantially fully received in said slot and an extended position wherein said blade extends from said handle to form an ice-ax; and detent means cooperating with said blade for releasably latching same in each of said positions, a piolet peen being pivotally mounted in said handle on the pivot axis of said blade, said peen being swingable from a retracted position inside the handle to an extended position in which said peen retracts in the direction opposite that of the blade.

10. The ski pole defined in claim 9, further comprising a spring acting upon said blade and said peen for swinging same into said extended position, said detent means including a lever for locking said blade and said peen in said extended and retracted positions respectively.

11. The ski pole defined in claim 9 wherein said shank is formed from two tubular elements detachably interconnected and including an upper element connected to said handle and a lower element connected to said snow-engaging means, said upper element being formed at its extremity remote from said handle with a piolet point receivable in said lower element.

12. The ski pole defined in claim 11, further comprising screw thread means for detachably interconnecting said elements.

13. The ski pole defined in claim 12 wherein said screw thread means includes a thread on said extremity of said upper element enabling connection thereof to an accessory.

14. The ski pole defined in claim 12 wherein said screw thread means includes a threaded upper extremity of said lower element enabling the connection thereof to an accessory.

* * * * *